US009170541B2

(12) United States Patent
Ikeda

(10) Patent No.: US 9,170,541 B2
(45) Date of Patent: Oct. 27, 2015

(54) IMAGE FORMING APPARATUS AND DENSITY UNEVENNESS CORRECTING METHOD

(71) Applicant: Konica Minolta, Inc., Tokyo (JP)

(72) Inventor: Makoto Ikeda, Tokyo (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/631,974

(22) Filed: Feb. 26, 2015

(65) Prior Publication Data

US 2015/0248093 A1 Sep. 3, 2015

(30) Foreign Application Priority Data

Feb. 28, 2014 (JP) ..... 2014-037761

(51) Int. Cl.
*G03G 15/00* (2006.01)

(52) U.S. Cl.
CPC ..... *G03G 15/5025* (2013.01)

(58) Field of Classification Search
CPC ..... G03G 15/5058; G03G 2215/00059; G03G 15/0131; G03G 2215/0164; G03G 2215/0129; G03G 15/5041; G03G 15/0194; G03G 15/0855; G03G 2215/00042; G03G 2215/00063; G03G 2215/00037; G03G 2215/1623
See application file for complete search history.

(56) References Cited

U.S. PATENT DOCUMENTS

2005/0047834 A1* 3/2005 Tomita et al. ..... 399/301
2006/0056867 A1* 3/2006 Taguchi ..... 399/49
2011/0299861 A1* 12/2011 Ogawa et al. ..... 399/15

FOREIGN PATENT DOCUMENTS

JP 2007-140402 A 6/2007

* cited by examiner

*Primary Examiner* — Roy Y Yi
(74) *Attorney, Agent, or Firm* — Osha Liang LLP

(57) ABSTRACT

Disclosed is an image forming apparatus including: an image forming unit configured to form an image on a conveyed recording medium; a density detecting unit configured to detect a density of the image formed on the recording medium; a phase detecting unit configured to detect a phase of a predetermined periodic member; a control unit configured to instruct the image forming unit to form a pattern on the recording medium, and to prepare correction data for one period of the periodic member from density data obtained by detecting the density of the pattern; and a density unevenness correcting unit configured to correct image data by repeatedly applying the correction data for one period so as to match with the phase of the periodic member, and to correct the density unevenness in the conveying direction, which is caused due to the periodic member.

8 Claims, 17 Drawing Sheets

IMAGE FORMING APPARATUS AND DENSITY UNEVENNESS CORRECTING METHOD

BACKGROUND OF THE INVENTION

1. Field of the Invention

The present invention relates to an image forming apparatus having a function of correcting the density unevenness in the conveying direction, which is caused on the recording medium, and a density unevenness correcting method.

2. Description of Related Art

In an image forming apparatus for printing an image on a recording sheet, the density unevenness is caused due to various types of factors. In order to suppress the density unevenness, the following correcting process is generally carried out. In the correcting process, a test image is printed on the recording sheet to measure the density by optically reading the test image, and the correction data is prepared so as to cancel the measured density unevenness. Then, by using the correction data, the image data to be printed is corrected.

The density unevenness is caused in the sub-scanning direction which is the conveying direction of the recording sheet, in addition to the main scanning direction which is perpendicular to the conveying direction of the recording sheet. Therefore, in order to precisely correct the density unevenness, it is desirable to correct not only the density unevenness in the main scanning direction, but also the density unevenness in the sub-scanning direction.

In the density unevenness caused in the sub-scanning direction, the density unevenness is caused as the periodic unevenness of the rotary member, such as the developing sleeve, the photoconductive drum, and the like. In order to correct the above density unevenness, it is necessary to correct the density unevenness so as to match with the period and the phase of the rotary member.

Because the phase of the rotary member is asynchronous with the timing of conveying the head of the sheet, or the like, it is necessary to obtain the special signal or the like to synchronize the phase of the rotary member with the head of the sheet. As an example, there is a method in which the home position signal (hereinafter, referred to as "HP signal") of the rotary member is obtained. The HP signal is a signal for informing that the rotary member is placed in the reference position, and is generated when the rotary member passes the reference position in every one rotation.

As an example for generating the HP signal, the plate having a half moon shape is attached to the rotation shaft, and the plate is read by a photoelectric sensor. The HP signal output by the photoelectric sensor is a rectangular wave in which one rotation of the rotary member is defined as one period. Therefore, in case that the timing at which the HP signal rises is monitored, it is possible to recognize the timing at which the rotary member is placed in the specific phase (the reference position) in one rotation.

In order to correct the periodic density unevenness caused due to the rotary member by matching with the period and the phase of the rotary member, it is necessary to prepare the correction data for one period of the rotary member. As a method for preparing the correction data, the following method has been generally adopted. In the method, a pattern having the uniform density is drawn in the sub-scanning direction on the recording medium, and the density unevenness is grasped by measuring the density of the above pattern with a density sensor. Then, the correction data for cancelling the measured density unevenness is prepared.

The density data obtained by drawing the pattern on the recording medium, which corresponds to one period of the rotary member to be corrected, and by measuring the pattern with the density sensor, includes the density unevenness caused due to the members other than the rotary member to be corrected (each rotary member having the different period from that of the rotary member to be corrected, and the like). The above density unevenness becomes a noise when the periodic density unevenness caused due to the rotary member to be corrected (hereinafter, also referred to as "periodic unevenness") is precisely obtained.

The long pattern corresponding to a plurality of periods of the rotary member to be corrected is drawn in the sub-scanning direction, and the density data obtained by measuring the density of the pattern is divided into a plurality of the density data for one period of the rotary member to be corrected in order to extract a plurality of the density data. By phasing the extracted density data to superpose and average the extracted density data, the noise caused due to the members other than the rotary member to be corrected is decreased. Then, the density unevenness data for one period, which is caused due to the rotary member to be corrected, is obtained.

The process for extracting a plurality of density data for one period of the rotary member to be corrected from the obtained density data is generally carried out in accordance with the HP signal. For example, in an example of FIG. 12, the pattern is drawn for seven periods in synchronization with the HP signal, and is measured by the density sensor. Then, the head position of the pattern drawn on the recording medium is detected in accordance with the change in the output value of the density sensor, and the density data having the length corresponding to the seven rotations of the rotary member is obtained from the head position of the pattern. By equally dividing the obtained density data into 7 sections, 7 pieces of density data for one period of the rotary member, which are started from the same phase, are extracted. By averaging the extracted 7 pieces of density data and preparing the averaged density data for one period, it is possible to obtain the density data in which the components caused due to other members having the different periods are eliminated. In FIG. 12, by carrying out the FFT process and the inverse FFT process, the unrelated frequency components are eliminated. However, the above processes may be omitted.

In the averaged density data and the correction data for one period, which is prepared in accordance with the averaged density data, the head position thereof is coincident with the rising of the HP signal. Therefore, the correction process for correcting the density unevenness by using the above correction data is also carried out in synchronization with the rising of the HP signal.

As shown in FIG. 13, in case that the pattern is dense and the density difference between the pattern and the original color of the recording medium is large, it is possible to precisely judge the head position of the pattern in accordance with the change in the output value of the density sensor. On the other hand, as shown in FIG. 14, in case that the pattern is thin and the density difference between the pattern and the original color of the recording medium is small, it is difficult to judge the head position of the pattern in accordance with the change in the output value of the density sensor.

In Japanese Patent Application Publication No. 2007-140402, in order to avoid the above problem, as shown in FIG. 15, the technology in which the marker having the high density is necessarily provided on the head position of the pattern, is disclosed. Therefore, it is possible to detect the head position of the pattern by using the marker even though the pattern is thin.

According to the technology disclosed in Japanese Patent Application Publication No. 2007-140402, it is possible to easily detect the head position of the pattern. However, the density data for one period is extracted with reference to the head position of the pattern by using the theoretical length corresponding to the one period of the rotary member. For example, as shown in FIG. 15, in case that one period of the rotary member corresponds to the T line in the sub-scanning direction, which is the theoretical value, the density data for one period is extracted by each T line from the position of the marker.

However, as shown in FIG. 16, in case that the actual length of one period of the rotary member on the recording medium (T' line) is different from the theoretical length (T line), even though the density data is extracted by using the theoretical length, the density data is not precisely extracted by one period. Therefore, even though the extracted density data are averaged, the noise caused due to the members other than the rotary member to be corrected cannot be precisely reduced.

As a factor which causes the actual length of one period of the rotary member on the recording medium to have a different value from the theoretical length, there is an error of the rotation rate of the rotary member. Further, there is a case in which the variable magnification is caused in the sub-scanning direction. For example, in case that the intermediate transfer belt is the recording medium, the difference between the actual length and the theoretical length is caused by the tension or the flexure of the intermediate transfer belt.

As shown in FIG. 17, instead of the extract of the density data using the theoretical length (T line), the HP signal is also supplied to the density sensor. In case that the density data output from the density sensor is extracted in accordance with the period of the HP signal, the shift caused due to the error of the rotation rate of the rotary member can be cancelled. However, even in the above method, as shown by the dashed line in the drawing, when the tension or the flexure of the intermediate transfer belt, the skew or the like is caused, the error caused due to this cannot be cancelled. Therefore, the density data cannot be extracted by one period with high precision.

SUMMARY

To achieve at least one of the abovementioned objects, an image forming apparatus reflecting one aspect of the present invention, comprises:

an image forming unit configured to form an image on a conveyed recording medium;

a density detecting unit configured to detect a density of the image formed on the recording medium by the image forming unit;

a phase detecting unit configured to detect a phase of a predetermined periodic member which is a component part of the image forming unit and which is periodically actuated;

a control unit configured to instruct the image forming unit to form a pattern for measuring a density unevenness in a conveying direction of the recording medium on the recording medium, and to prepare correction data for one period of the periodic member from density data obtained by detecting the density of the pattern with the density detecting unit, the correction data being used for correcting the density unevenness in the conveying direction, which is caused due to the periodic member; and a density unevenness correcting unit configured to correct image data to be supplied to the image forming unit by repeatedly applying the correction data for one period so as to match with the phase of the periodic member, which is detected by the phase detecting unit, and to correct the density unevenness in the conveying direction, which is caused due to the periodic member, wherein the control unit instructs the image forming unit to form a first reference mark and a second reference mark at an interval in the conveying direction and the pattern having a length corresponding to two or more periods of the periodic member between the first reference mark and the second reference mark in the conveying direction, on the recording medium, wherein the control unit obtains the phase of the periodic member at a first timing at which the first reference mark is formed on the recording medium or the phase of the periodic member at a second timing at which the second reference mark is formed on the recording medium, and number of the periods during which the periodic member is actuated between the first timing and the second timing in accordance with the phase detected by the phase detecting unit, wherein the control unit calculates a relation between each position in the density data and the phase of the periodic member in accordance with at least one of the phase of the periodic member at the first timing and the phase of the periodic member at the second timing, the number of the periods during which the periodic member is actuated between the first timing and the second timing, a position corresponding to the first reference mark in the density data and a position corresponding to the second reference mark in the density data, wherein the control unit obtains a portion corresponding to a plurality of periods from a predetermined phase of the periodic member in the density data in accordance with the relation, and calculates the density data for one period by summarizing the obtained portion, and wherein the control unit prepares the correction data for one period of the periodic member in accordance with the calculated density data for one period.

Preferably, in case that the second reference mark is continuous with the pattern, a density of the second reference mark is differentiated from a density of the pattern.

Preferably, in a predetermined range from the first reference mark toward a downstream side in the conveying direction, the pattern is not formed, or the density data is not obtained from the predetermined range.

Preferably, positions of the first reference mark and the second reference mark in a direction perpendicular to the conveying direction are different from a position of the pattern in the direction perpendicular to the conveying direction.

Preferably, positions of the first reference mark and the second reference mark in a direction perpendicular to the conveying direction are same as a position of the pattern in the direction perpendicular to the conveying direction.

Preferably, the first timing and the second timing are a timing at which the periodic member has an identical predetermined phase.

Preferably, the periodic member executes a rotative motion.

BRIEF DESCRIPTION OF THE DRAWINGS

The present invention will become more fully understood from the detailed description given hereinafter and the accompanying drawings given by way of illustration only, and thus are not intended as a definition of the limits of the present invention, and wherein:

FIG. 4 is a view showing an example of the test image which is formed on the intermediate transfer belt by the image forming apparatus, and the like;

DETAILED DESCRIPTION OF PREFERRED EMBODIMENT

Hereinafter, a preferred embodiment of the present invention will be explained with reference to the accompanying drawings.

Figure 1:
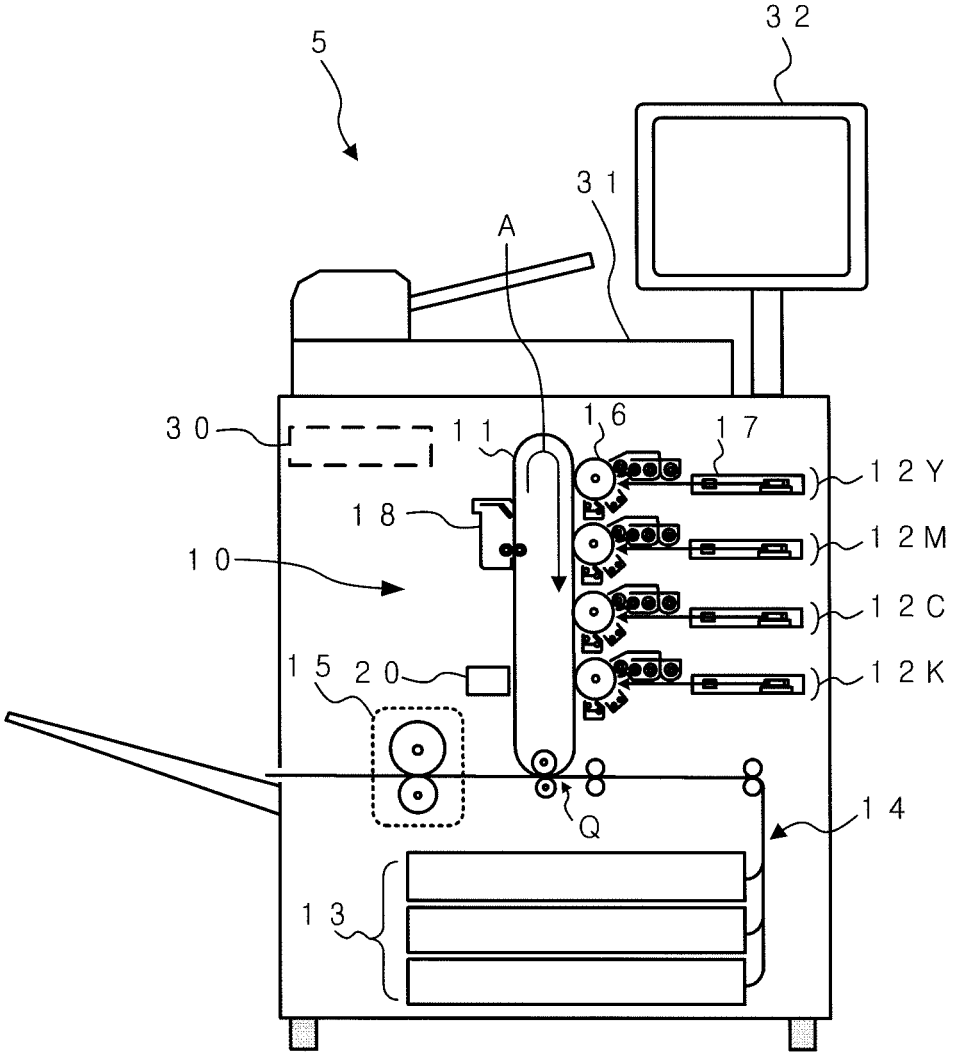
FIG. 1 is a view showing the schematic mechanical configuration of the image forming apparatus according to the embodiment.

FIG. 1 is a view showing the schematic mechanical configuration of the image forming apparatus 5 according to the embodiment. The image forming apparatus 5 has the print function for printing out the image on the recording sheet in accordance with the print data input from an external terminal via a network or the like, the copy function for printing out an image on the recording sheet by optically reading an original, and the like.

The image forming apparatus 5 comprises an image forming unit 10 which comprises an endless intermediate transfer belt 11 that is bridged annularly and that has a predetermined width, four toner image forming units 12Y, 12M, 12C and 12K which form single color toner images having the colors of yellow (Y), magenta (M), cyan (C) and black (K), respectively on the intermediate transfer belt 11, a sheet feeding unit 13 for feeding recording sheets, a conveying unit 14 for conveying the fed recording sheets, a fixing device 15, a belt cleaning device 18, and the like. The image forming apparatus 5 comprises a density detecting unit 20 for detecting the density of the image by optically reading the image on the intermediate transfer belt 11.

The toner image forming units 12Y, 12M, 12C and 12K use toners of different colors, but have the same structure. Each of the toner image forming units 12Y, 12M, 12C and 12K comprises a cylindrical photoconductive drum 16 that functions as an electrostatic latent image carrier on which an electrostatic latent image is formed, and comprises a charging device, a developing device, a transferring device, a cleaning device 25, and the like that are arranged around the photoconductive drum 16. Further, each of the toner image forming units 12Y, 12M, 12C and 12K has a laser unit 17 that includes a laser diode, a polygon mirror, various types of lenses and mirrors, and the like.

In each of the toner image forming units 12Y, 12M, 12C and 12K, the photoconductive drum 16 is driven by a driving unit not illustrated in the drawings to be rotated in a predetermined direction. The charging device uniformly charges the photoconductive drum 16. The laser unit 17 scans the photoconductive drum 16 with laser light that is turned on and off in accordance with image data of the corresponding color to form the electrostatic latent image on the surface of the photoconductive drum 16.

The laser light scans the photoconductive drum 16 repeatedly in the shaft direction thereof. By rotating the photoconductive drum 16, a two-dimensional electrostatic latent image is formed on the photoconductive drum 16. The direction in which the laser light scans the surface of the photoconductive drum 16 (the shaft direction of the photoconductive drum) is referred to as the main scanning direction. The direction in which the photoconductive drum 16 is rotated is referred to as the sub-scanning direction.

The developing device visualizes the electrostatic latent image formed on the photoconductive drum 16 by using a toner. The toner image formed on the surface of the photoconductive drum 16 is transferred on the intermediate transfer belt 11 at the position where the photoconductive drum 16 contacts with the intermediate transfer belt 11. The cleaning device 25 removes and collects the toner which remains on the surface of the photoconductive drum 16 by rubbing the remaining toner with a blade or the like after the transfer of the toner image.

The intermediate transfer belt 11 is wound so as to be bridged by a plurality of rollers, and is rotated at the constant speed in the direction of the arrow A in the drawing. In a process of the rotation of the intermediate transfer belt 11, the images (toner images) of the respective colors are formed on the intermediate transfer belt 11 so as to overlap the images in the order of the color Y, the color M, the color C and the color K by the toner image forming units 12Y, 12M, 12C and 12K. Thereby, the color image is composed. This color image is transferred from the intermediate transfer belt 11 to the recording sheet at a second transferring position Q. The toner which remains on the intermediate belt 11 after the transfer is removed by the belt cleaning device 18 which is provided on the downstream side of the second transferring position Q.

On the intermediate transfer belt 11, the width direction of the intermediate transfer belt 11 is the main scanning direction, and the direction in which the intermediate transfer belt 11 rotates (the direction perpendicular to the main scanning direction) is the sub-scanning direction. Further, on the recording sheet, the conveying direction of the recording sheet is the sub-scanning direction, and the direction perpendicular to the conveying direction (the width direction of the recording sheet) is the main scanning direction.

The sheet feeding unit 13 comprises a plurality of sheet feed trays that contain recording sheets used in printing. The sheet feeding unit 13 feeds the recording sheets one by one from the selected sheet feed tray toward the conveying unit 14. The conveying unit 14 has the function for conveying the recording sheet fed from the sheet feed tray so as to pass the recording sheet through the second transferring position Q and the fixing device 15, and discharging the recording sheet to a discharge tray. The conveying unit 14 is configured by conveying rollers and a guide unit that form a conveying passage, and by a motor that drives the conveying rollers.

Further, the image forming apparatus 5 comprises a control board 30 for controlling the operation of the image forming apparatus 5, a scanner unit 31 that reads an original set by a user, an operation panel unit 32 that receives the operation from a user and that displays various types of windows, and the like. The control board 30 is configured as a main unit comprising a CPU (Central Processing Unit), a ROM (Read Only Memory), a RAM (Random Access Memory) and the like. The control board 30 executes the process in accordance with the program stored in the ROM and controls the operation of each unit of the image forming apparatus 5.

The image forming unit 10 comprises a plurality of periodic members which are actuated periodically, as the component parts thereof. The periodic member repeatedly executes one period of motion. For example, the periodic member includes the photoconductive drum 16 and the developing device which execute the rotative motion, and the like. The periodic member is not limited to the member which executes the rotative motion, and may include the member which executes the reciprocal motion. Each periodic member has a unique period.

The image forming apparatus 5 has the function for correcting the density unevenness in the sub-scanning direction, which is caused due to the above periodic members. Hereinafter, the correction of the density unevenness in the sub-scanning direction will be explained in detail.

Figure 2:
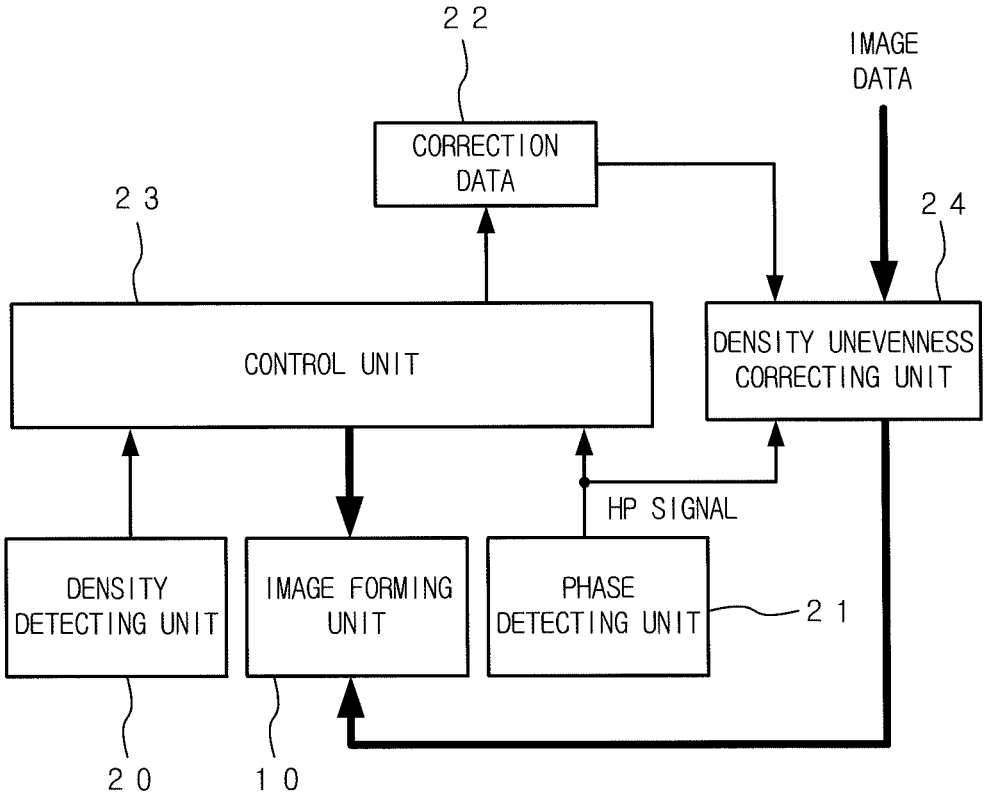
FIG. 2 is a block diagram showing the portion relating to the correction of the density unevenness in the sub-scanning direction, which is extracted from the image forming apparatus.

FIG. 2 shows the schematic configuration of the portion relating to the correction of the density unevenness in the sub-scanning direction, which is extracted from the image forming apparatus 5. The above portion comprises the image forming unit 10 for forming an image on the conveyed recording sheet, the density detecting unit 20 for detecting the density of the test image formed on the recording medium by the image forming unit 10, a phase detecting unit 21 for detecting the phase of the predetermined periodic member of the image forming unit 10, which executes the periodic motion, a control unit 23 for instructing the image forming unit 10 to form the test image and instructing the density detecting unit 20 to detect the density of the test image and preparing the correction data 22 for correcting the density unevenness in the sub-scanning direction, which is caused due to the predetermined periodic member to be corrected, from the density data obtained by the density detecting unit 20, a density unevenness correcting unit 24 for correcting the density unevenness in the sub-scanning direction, which is caused due to the above periodic member, in the correction data 22, and the like.

The control unit 23 prepares the correction data for one period of the periodic member from the density data obtained by reading the test image. The density unevenness correcting unit 24 corrects the image data to be supplied to the laser unit 17 of the image forming unit 10 by repeatedly applying the correction data for one period of the periodic member so as to match with the phase of the periodic member, which is detected by the phase detecting unit 21.

In this embodiment, it is assumed that the recording medium on which the test image is formed is the intermediate transfer belt 11 and the periodic member to be corrected is the photoconductive drum 16.

Figure 3:
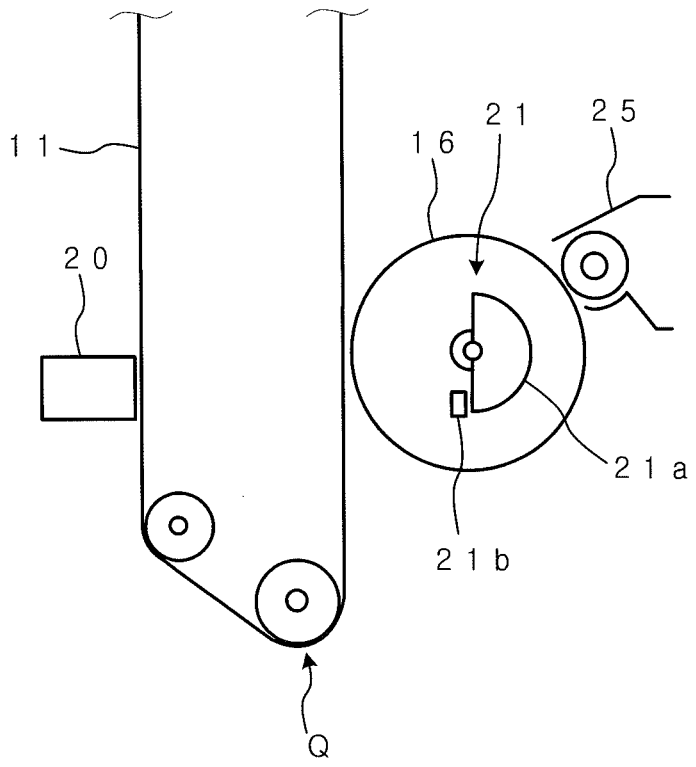
FIG. 3 is an enlarged view showing a part of the image forming unit.

FIG. 3 is an enlarged view showing of a part of the image forming unit 10. The phase detecting unit 21 detects the phase of the photoconductive drum 16 arranged along the intermediate transfer belt 11. In the phase detecting unit 21, the plate having a half moon shape is used as described in the Description of Related Art. The phase detecting unit 21 comprises a plate 21*a* attached so as to have the same rotation shaft as the photoconductive drum 16 and a photoelectric sensor 21*b* attached on the position on which the light is periodically obscured by rotating the plate 21*a*. The photoelectric sensor 21*b* outputs the HP signal which is the rectangular wave having the period corresponding to one rotation of the photoconductive drum 16.

Figure 4:
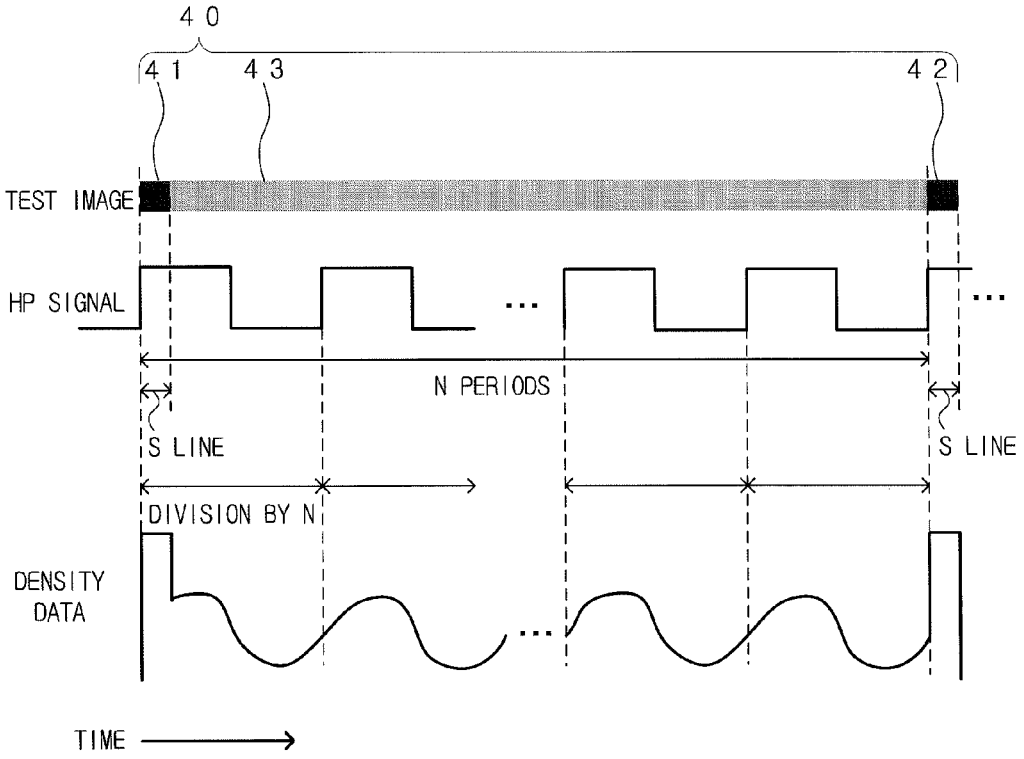
Figure 5:
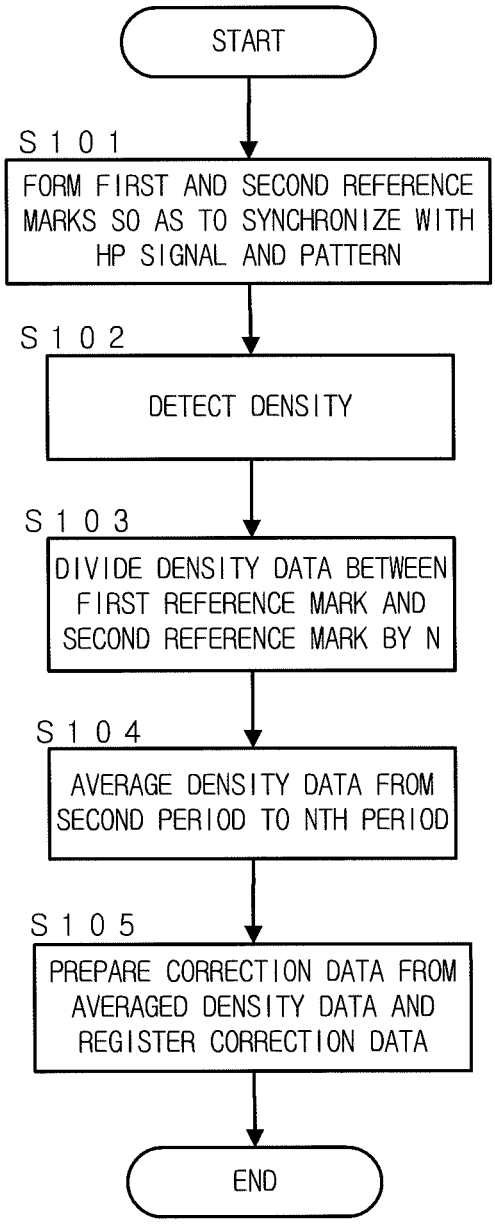
FIG. 5 is a flowchart showing the process which is carried out by the control unit when the correction data is prepared in accordance with the test image.

FIG. 4 shows an example of the test image 40 which is formed on the intermediate transfer belt 11 by the image forming apparatus 5. In FIG. 4, the abscissa axis indicates time. FIG. 5 is a flowchart showing the process which is carried out when the correction data is prepared in accordance with the test image.

As shown in FIG. 4, the test image 40 has a first reference mark 41 and a second reference mark 42 which are arranged in the sub-scanning direction at some interval, and a pattern 43 which is arranged between the first reference mark 41 and the second reference mark 42 in the sub-scanning direction and which has the length corresponding to not less than two periods of the periodic member to be corrected. The pattern 43 is an image which is suitable for the detection of the density unevenness in the sub-scanning direction. In this embodiment, the pattern 43 is an image having a long strip shape elongated in the sub-scanning direction and having the constant density.

Each of the first reference mark 41 and the second reference mark 42 is a colored mark having the high density (in this embodiment, the black having the highest density) so as to sufficiently secure the density difference between the original color of the intermediate transfer belt 11 which is the recording medium and each mark.

In the example of FIG. 4, each of the first reference mark 41 and the second reference mark 42 has a length of the S line in the sub-scanning direction. In case of the first reference mark 41, the image forming is started so as to synchronize with the rising of the HP signal. In case of the second reference mark 42, the image forming is started so as to synchronize with the rising of the HP signal after N periods from the first reference mark 41. The pattern 43 is formed between the ending point of the first reference mark 41 and the starting point of the second reference mark 42.

In this example, in case that the phase of the rising of the HP signal is 0 degree, the phase of the periodic member at both of the first timing at which the first reference mark 41 is formed and the second timing at which the second reference mark 42 is formed, is 0 degree. Further, the number of the periods during which the periodic member is rotated from the first timing and the second timing is N.

When the control unit 23 prepares the correction data in accordance with the test image, the control unit 23 controls the image forming unit 10 as follows. The image forming unit 10 forms the first reference mark 41 so as to synchronize with the rising of the HP signal output by the phase detecting unit 21 and then forms the pattern 43. After the N periods from the image forming of the first reference mark 41, the image forming unit 10 forms the second reference mark 42 so as to synchronize with the rising of the HP signal (FIG. 5: Step S101).

The control unit 23 obtains the density data by reading the test image formed in Step S101, with the density detecting unit 20 arranged on the downstream side of the photoconductive drum 16 (Step S102).

As shown in FIG. 4, in the density data obtained by reading the test image 40 with the density detecting unit 20, because the rectangular peak appears on the positions corresponding to the first reference mark 41 and the second reference mark 42, it is possible to clearly recognize the positions on the density data, which correspond to the first reference mark 41 and the second reference mark 42. The value of the density data in the part corresponding to the pattern 43 varies according to the density unevenness in the sub-scanning direction.

As described above, in case of the first reference mark 41, the image forming is started so as to synchronize with the rising of the HP signal. In case of the second reference mark 42, the image forming is started so as to synchronize with the rising of the HP signal after N periods from the first reference mark 41. Therefore, the length from the rising of the rectangular wave, which corresponds to the first reference mark 41 appearing on the density data to the rising of the rectangular wave, which corresponds to the second reference mark 42, exactly corresponds to the N periods of the HP signal.

Therefore, the control unit 23 obtains the part between the position (the rising of the rectangular wave) corresponding to the first reference mark 41 and the position corresponding to the second reference mark 42, from the detected density data. Then, the obtained part is equally divided into N (Step S103). Each density data extracted by dividing the obtained data is the density data for one period, in which the head position of the period is coincident with the rising of the HP signal.

Because the first period includes the rectangular wave corresponding to the first reference mark 41, the density data for the first period is not used. The density data obtained from the second period to the Nth period are superposed and the superposed density data is divided by (n−1) to average the obtained density data (Step S104). In the averaged density data, the density unevenness caused due to the members other than the periodic member to be corrected is cancelled, and the density unevenness in the sub-scanning direction, which is caused due to the periodic member to be corrected, is shown with high precision.

The control unit 23 prepares the correction data 22 for cancelling the density unevenness shown in the averaged density data for one period, from the above averaged density data, and registers the correction data 22 in a nonvolatile memory or the like (Step S105).

For example, in case that 100 lines are formed during one period of the periodic member to be corrected, the density data for one period is sampled at an interval of 1/100 period. The correction value corresponding to each sampled density is calculated, and a lookup table in which the correction values are registered in the order of the sampling so as to relate each correction value to the input address having the address value between 1 and 100, is prepared and stored.

Figure 6:
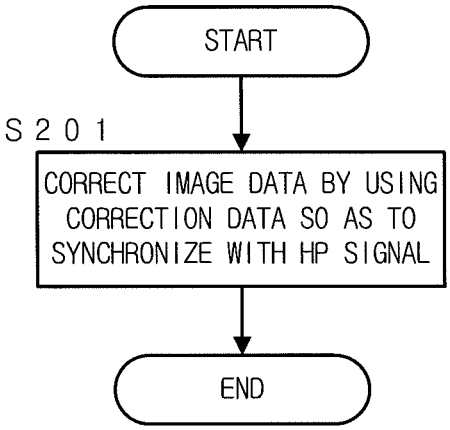
FIG. 6 is a flowchart showing the process in which the density unevenness correcting unit corrects the density unevenness in the sub-scanning direction by using the correction data.

FIG. 6 shows the process in which the density unevenness correcting unit 24 corrects the density unevenness in the sub-scanning direction by using the correction data 22. The density unevenness correcting unit 24 repeatedly corrects the density of the image data by applying the correction data for one period to the image data from the head position thereof so as to synchronize with the rising of the HP signal (Step S201).

For example, the operation for reading out the correction data from the above-described lookup table in which the correction data are registered, by incrementing the address from 1 to 100 at the interval of 1/100 period of the HP signal so as to synchronize with the rising of the HP signal, is circulatedly executed. Then, the density of the image data for each line is sequentially corrected by using the read correction data and the corrected image data is output to the image forming unit 10. Alternatively, the image data for each page is corrected line by line from the first line in the sub-scanning direction by circulatedly applying the correction data related to the address values between 1 and 100, which are registered in the lookup table. Then, the image is formed on the basis of the corrected image data from the first line so as to synchronize with the rising of the HP signal.

As described above, in the image forming unit 10 according to the embodiment, because the test image including the pattern 43 having the length corresponding to a plurality of periods of the periodic member to be corrected, is formed between the first reference mark 41 and the second reference mark 42, the density data obtained by reading the test image can be divided into a plurality of density data for one period of the periodic member to be corrected, in accordance with the first reference mark 41 and the second reference mark 42. By averaging the density data extracted by dividing the obtained density data for a plurality of periods, the density unevenness caused due to the other members is cancelled. Therefore, the density unevenness in the sub-scanning direction, which is caused due to the periodic member to be corrected, can be precisely detected and the above density unevenness can be corrected with high precision.

Figure 7:
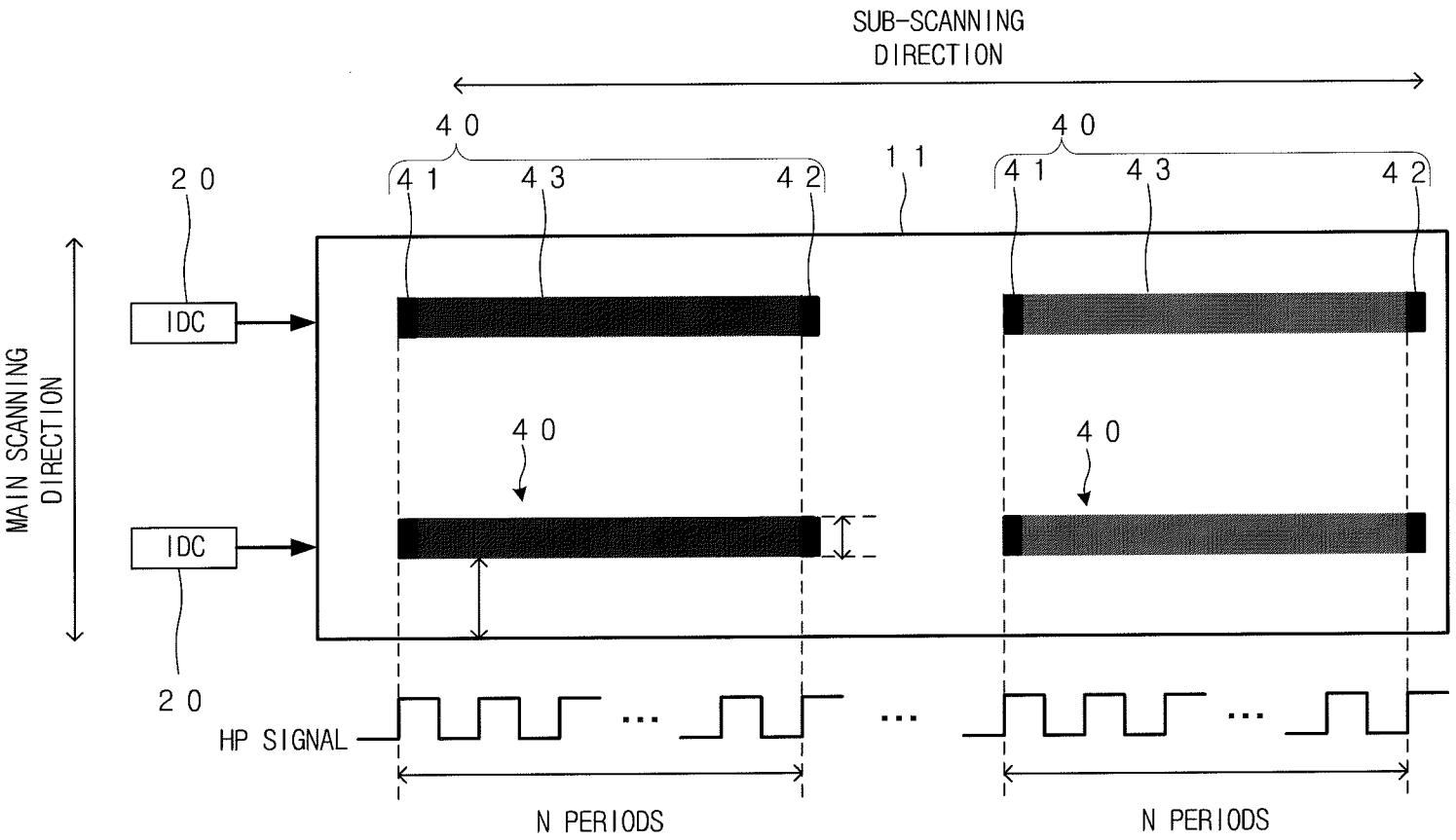
FIG. 7 is a view showing an example of the test image which is formed on the intermediate transfer belt.

FIG. 7 shows an example of the test image 40 which is formed on the intermediate transfer belt 11. In FIG. 7, two test images 40 are formed on one side of the intermediate transfer belt 11 and the other side thereof in the width direction of the intermediate transfer belt 11, respectively. In each test image 40, the first reference mark 41, the second reference mark 42 and the pattern 43 are formed on the same position in the main scanning direction. In this example, the density detecting unit 20 for reading the test image 40 formed on one side of the intermediate transfer belt 11 in the width direction thereof, and the density detecting unit 20 for reading the test image 40 formed on the other side of the intermediate transfer belt 11, are provided.

As shown in FIG. 7, in case that the second reference mark 42 is continuous with the pattern 43, the density of the second reference mark 42 is differentiated from that of the pattern 43 so as to easily recognize the boundary therebetween (the starting point of the second reference mark 42) by using the density difference. Preferably, the density difference is not less than the predetermined value.

Figure 8:
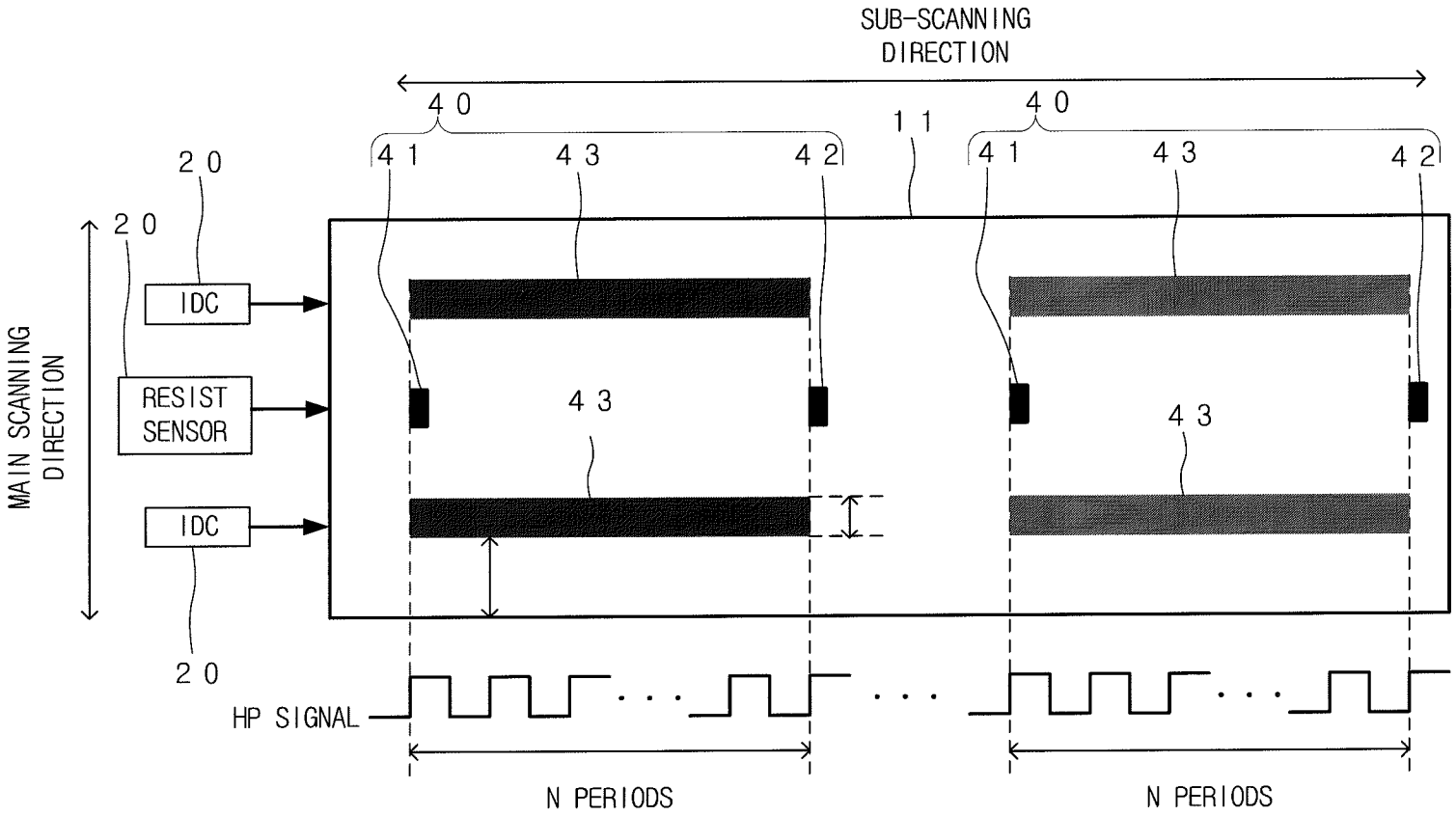
FIG. 8 is a view showing an example of the test image in which the positions of the first reference mark and the second reference mark in the main scanning direction are differentiated from the position of the pattern in the main scanning direction.

FIG. 8 shows an example in which the positions of the first reference mark 41 and the second reference mark 42 in the main scanning direction are differentiated from the position of the pattern 43 in the main scanning direction. In FIG. 8, in the test image 40, the patterns 43 are formed on one side of the intermediate transfer belt 11 and on the other side thereof in the width direction of the intermediate transfer belt 11 (the main scanning direction), respectively. In the middle of the intermediate transfer belt 11 in the width direction thereof, the first reference mark 41 and the second reference mark 42 are formed.

Therefore, in FIG. 8, in addition to the density detecting units 20 shown in FIG. 7, the density detecting unit 20 for reading the first reference mark 41 and the second reference mark 42 is provided on the position corresponding to the first reference mark 41 and the second reference mark 42 in the main scanning direction.

In case of FIG. 7, when the density difference between the pattern 43 and the second reference mark 42 is small, it is difficult to judge the boundary between the ending point of the pattern 43 and the second reference mark 42 in the density data. However, because the ending point of the second reference mark 42 can be clearly judged, the starting point of the second reference mark 42 can be almost precisely found by returning from the ending point of the second reference mark 42 by the length of the second reference mark 42 (for example, the S line).

In case of FIG. 8, even though the pattern 43 has a high density and the density difference between the pattern 43 and the second reference mark 42 is small or there is no density difference, it is possible to precisely judge the starting point of the second reference mark 42 in the density data. Further, in case of FIG. 8, because the density data of the first reference mark 41 and the density data of the pattern 43 can be obtained as the separate data, the rectangular wave corresponding to the first reference mark 41 is not mixed in the density data corresponding to the first period in the pattern 43. Therefore, the density data corresponding to the first period in the pattern 43 can be used for the averaging of the density data.

As shown in FIG. 7, in case that the first reference mark 41 and the second reference mark 42 are formed on the same position in the main scanning direction as the pattern 43, the front side portion of the pattern 43 is influenced due to the formed first reference mark 41 by the memory effect of the photoconductive drum 16 (the effect in which there remains an influence of the image which was formed in the previous printing). As a result, there is some possibility that the detected density of the pattern 43 is different from the original density of the pattern 43. In particular, in case that the density of the pattern 43 is lower than the density of the first reference mark 41, the pattern 43 is largely influenced by the memory effect.

Figure 9:
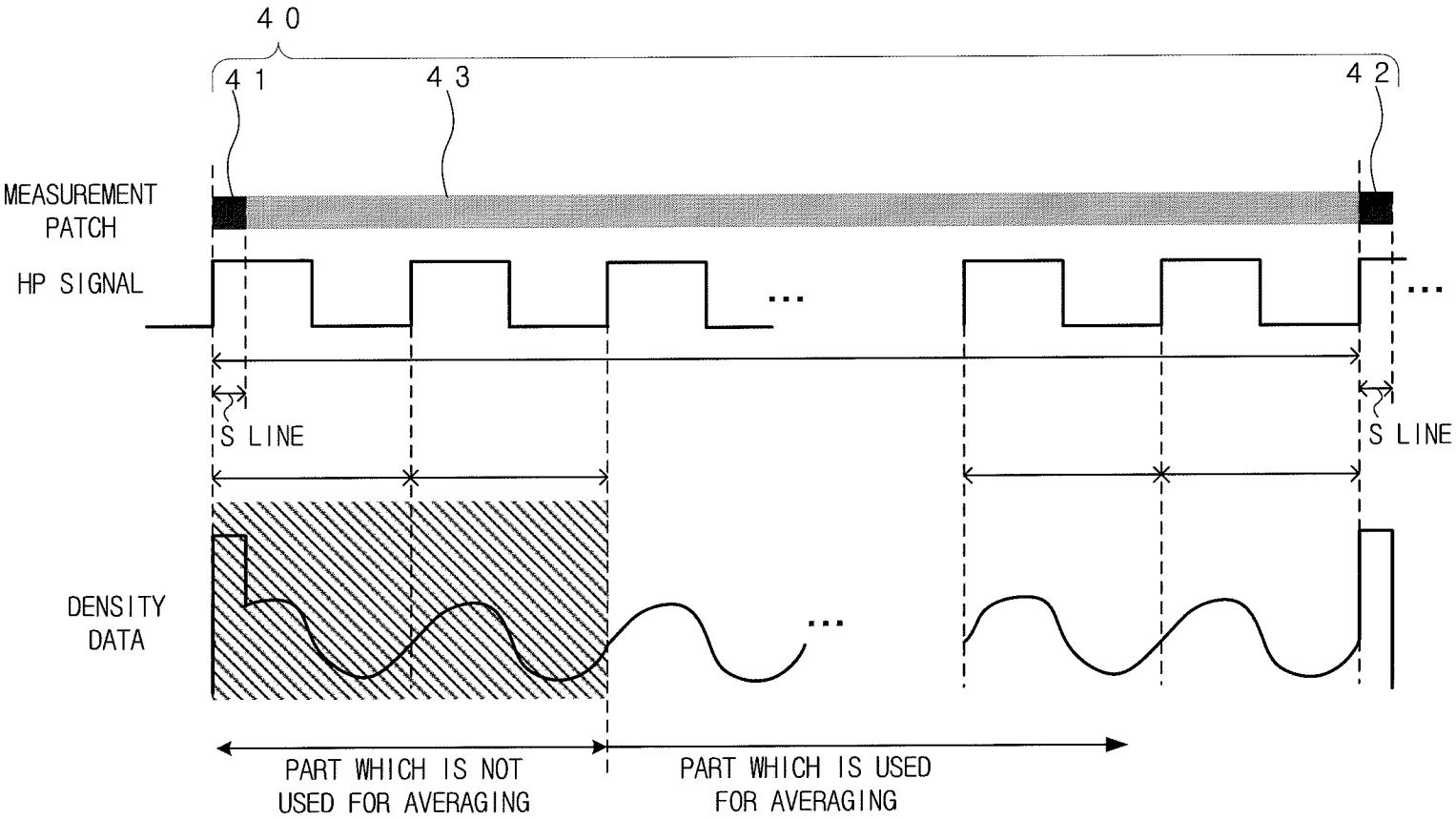
FIG. 9 is a view showing an example in which the density data having the predetermined range from the first reference mark toward the second reference mark is discarded and is not used for the averaging.

In this case, as shown in FIG. 9, the density data having the predetermined range from the first reference mark 41 toward the second reference mark 42 is discarded and is not used for the averaging of the density data. Then, the pattern 43 in which the pattern having the length corresponding to the discarded density data is added, is formed. In the example of FIG. 8, the density data for two periods from the starting point of the test image 40 is not used for the averaging of the density data. The range in which the density data is not used for the averaging may be suitably set according to the degree of the memory effect and the like.

Figure 10:
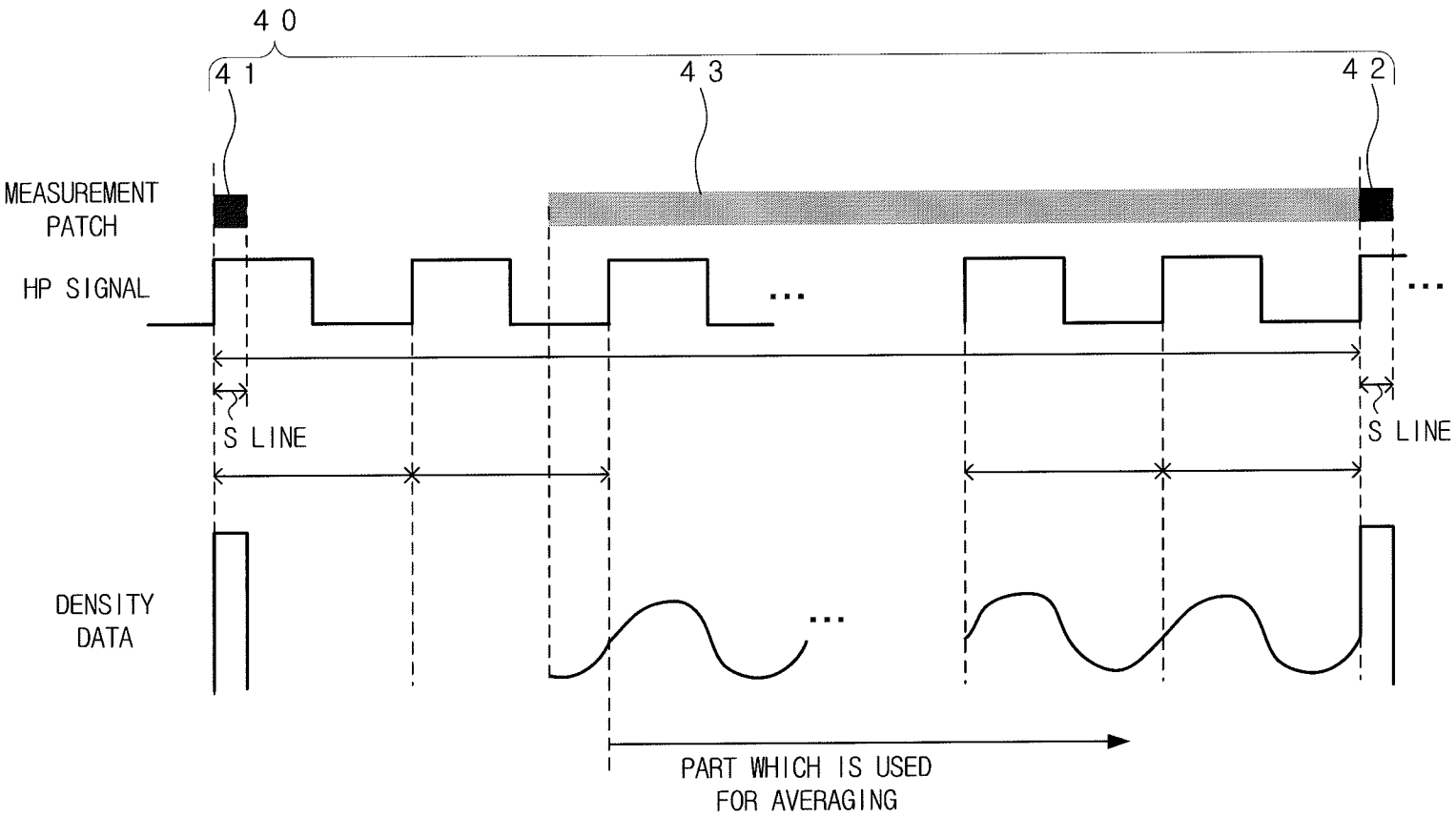
FIG. 10 is a view showing the test image in which the pattern is not formed in the predetermined range from the first reference mark.

In the test image 40 shown in FIG. 7 and the like, the pattern 43 is formed within the all range from the first reference mark 41 and the second reference mark 42. However, it is not necessary to form the pattern 43 within the all range. As shown in FIG. 10, it is not necessary to form the pattern 43 in the predetermined range following the first reference mark 41. For example, in the predetermined range from the first reference mark 41 toward the downstream side in the sub-scanning direction (for example, the range in which the memory effect is caused due to the first reference mark 41), it is not necessary to form pattern 43.

Example

In this embodiment described above, the test image 40 is formed so as to synchronize with the HP signal. However, the test image 40 may be read by referring the HP signal.

Figure 11:
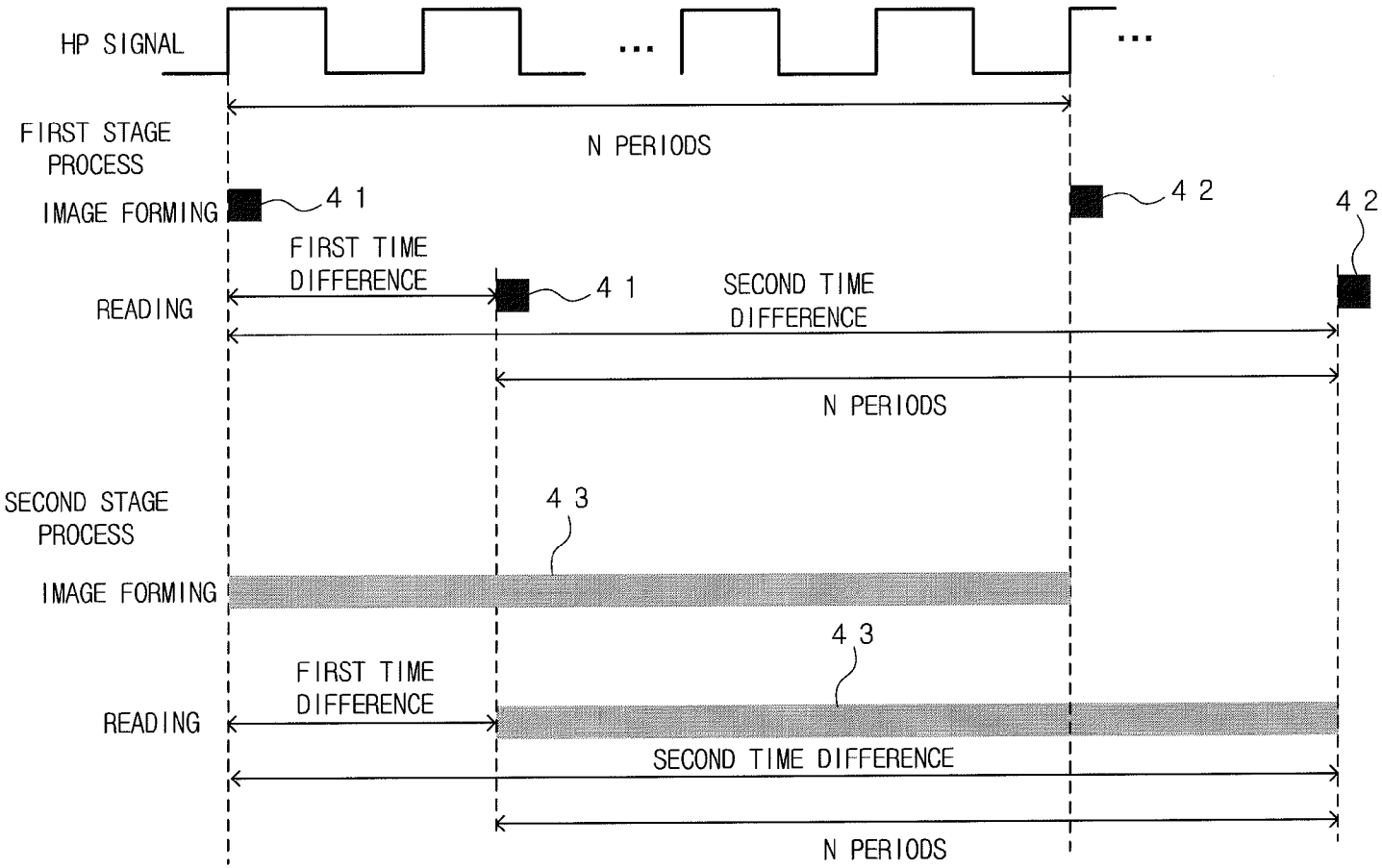
FIG. 11 is a view showing an example in which the HP signal is used also on the reading side on which the test image is read.
Figure 12:
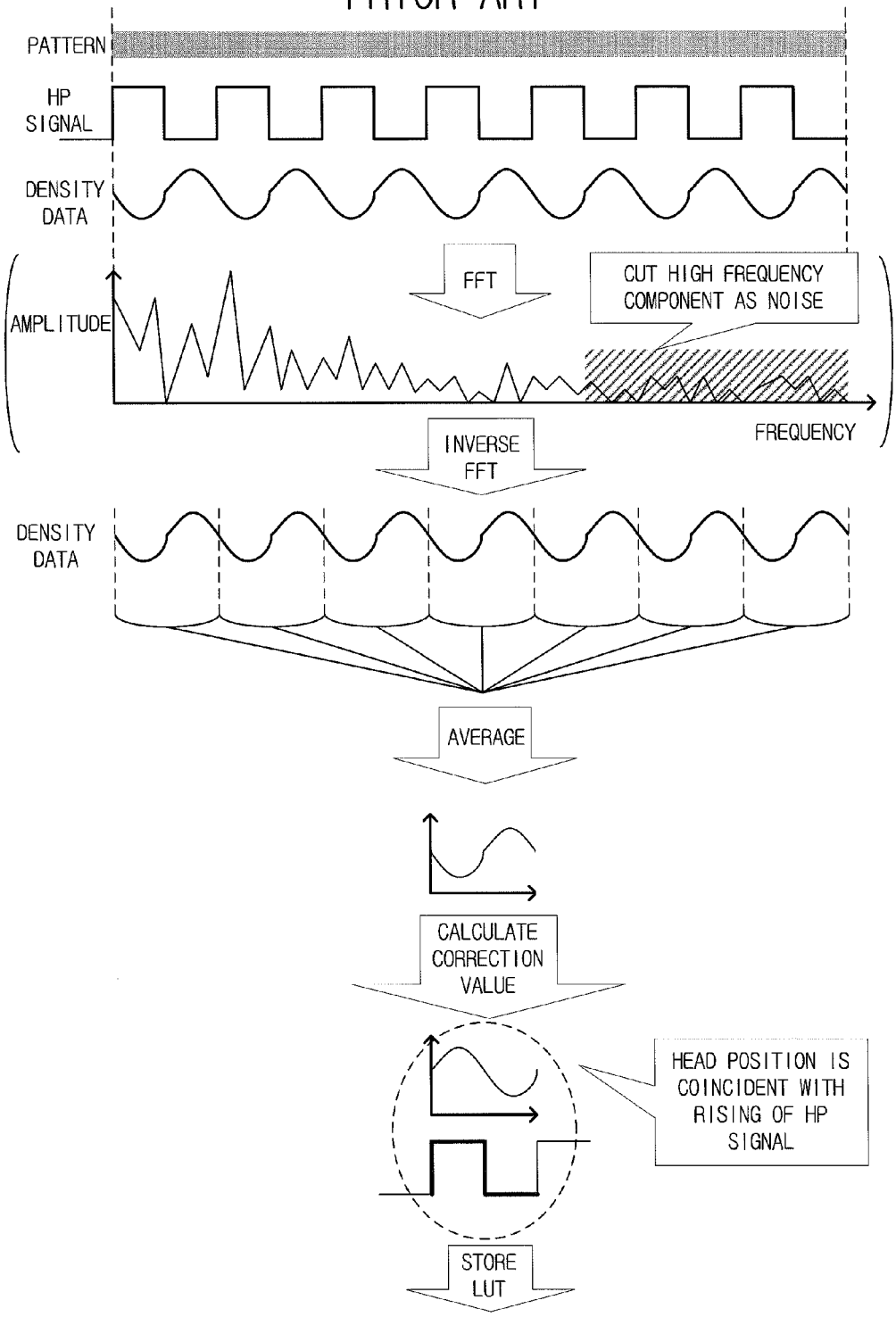
FIG.12 PRIOR ART
FIG. 12 is a view showing a conventional process for measuring the density unevenness in the sub-scanning direction.
Figure 13:
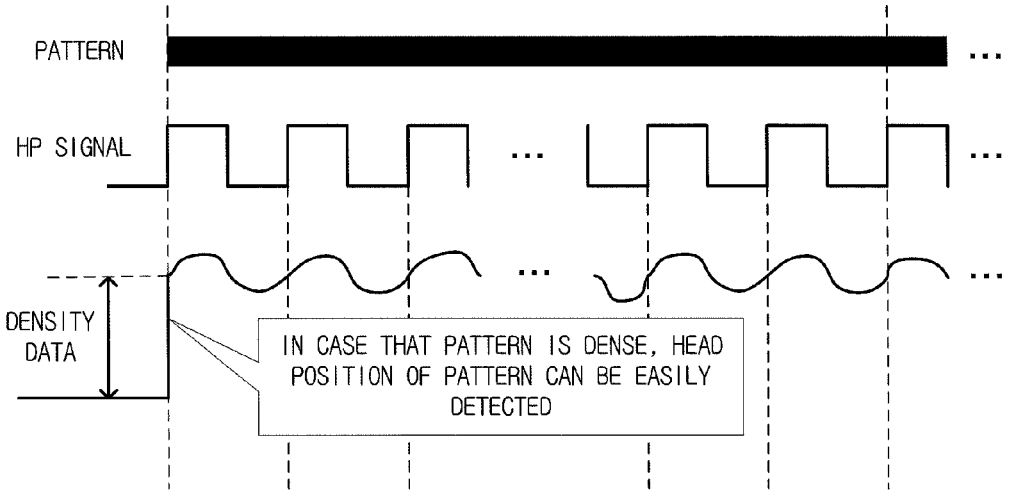
FIG.13 PRIOR ART
FIG. 13 is a view showing an example in which the density difference between the pattern and the original color of the recording medium is large.
Figure 14:
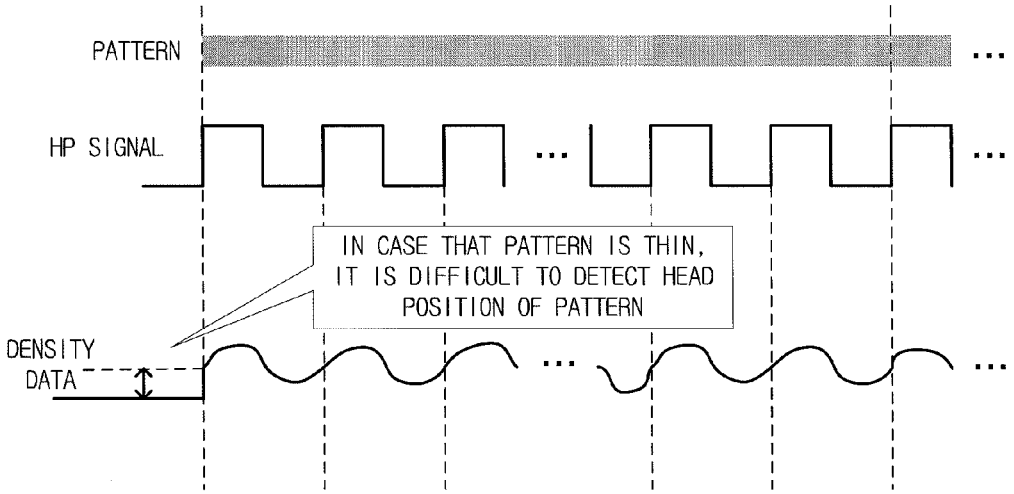
FIG.14 PRIOR ART
FIG. 14 is a view showing an example in which the density difference between the pattern and the original color of the recording medium is small.
Figure 15:
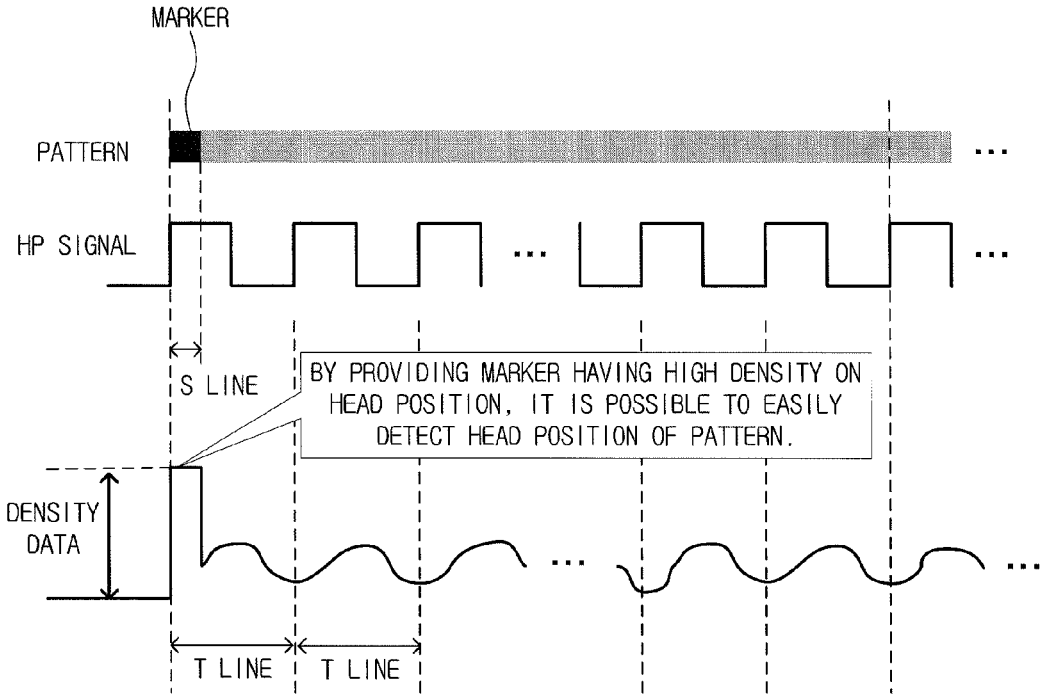
FIG.15 PRIOR ART
FIG. 15 is a view showing a conventional technology in which the marker having the high density is provided on the head position of the pattern.
Figure 16:
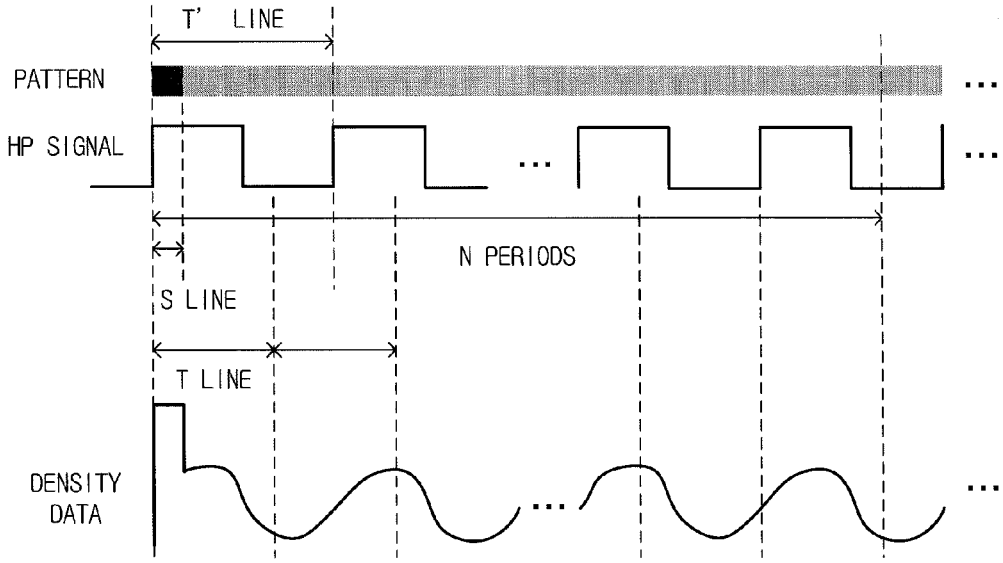
FIG.16 PRIOR ART
FIG. 16 is a view showing an example in which the actual length of one period of the rotary member on the recording medium (T' line) is different from the theoretical length (T line)
Figure 17:
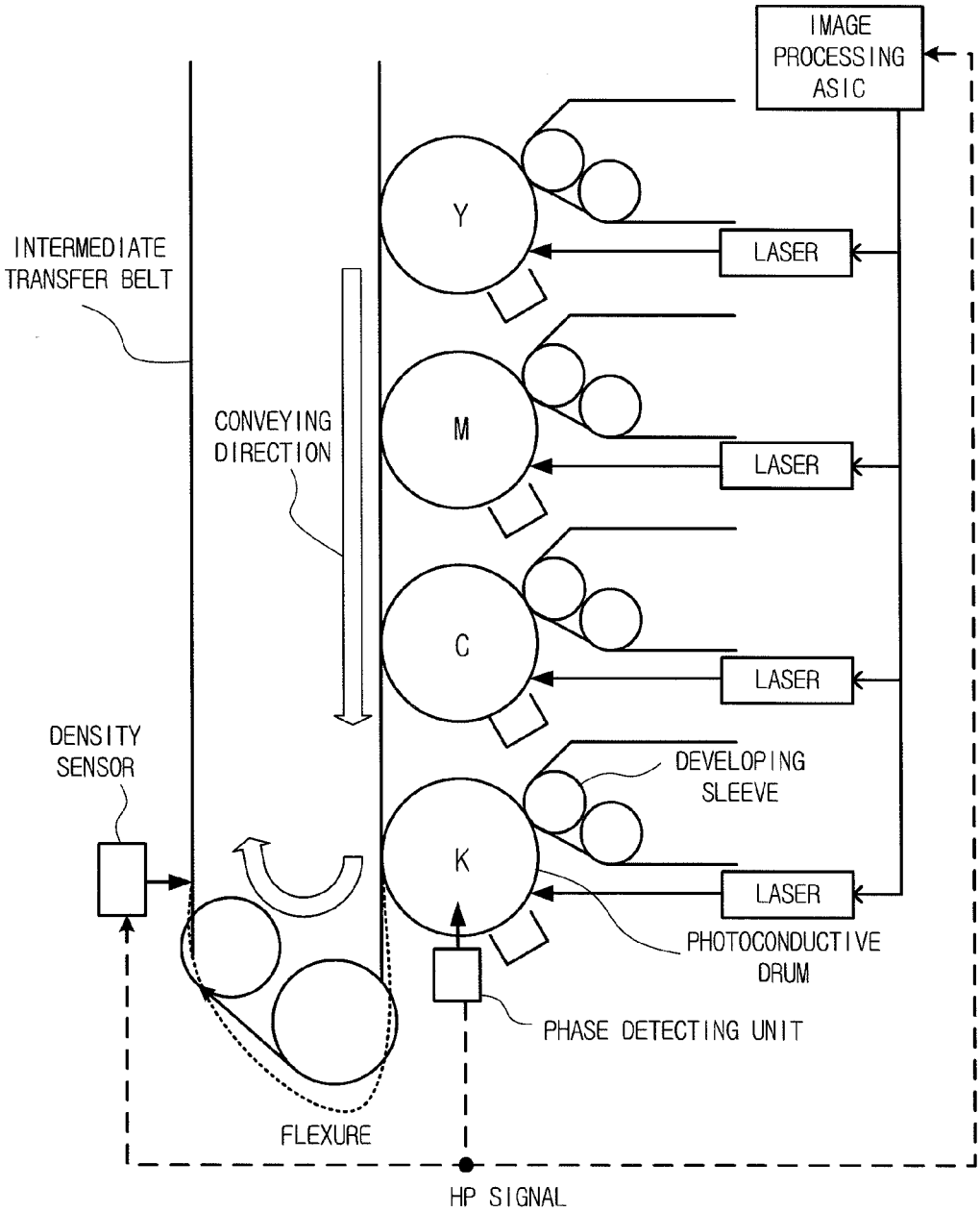
FIG.17 PRIOR ART
FIG. 17 is a view showing the problem which is caused in case that the HP signal is also supplied to the density sensor and the density data output from the density sensor is extracted in accordance with the period of the HP signal.

FIG. 11 shows an example in which the HP signal is used also on the reading side on which the test image 40 is read. In this example, the first stage process in which only the first reference mark 41 and the second reference mark 42 are formed and read, and the second stage process in which only the pattern 43 is formed and read, are carried out.

In the first stage process, the first reference mark 41 is formed so as to synchronize with the rising of the HP signal, and the second reference mark 42 is formed so as to synchronize with the rising of the HP signal after N periods. Then, the reference marks are read by the density detecting unit 20. At this time, the time difference (the first time difference) between the timing at which the first reference mark 41 is formed and the timing at which the first reference mark 41 is detected, and the time difference (the second time difference) between the timing at which the first reference mark 41 is formed and the timing at which the second reference mark 42 is detected, are grasped.

In the second stage process, the image forming of the pattern 43 is started so as to synchronize with the rising of the HP signal, and is finished so as to synchronize with the rising of the HP signal after N periods. On the reading side, the image which is read between the timing at which the first time difference has elapsed since the starting of the image forming of the pattern 43 and the timing at which the second time difference has elapsed since the starting of the image forming of the pattern 43, is recognized as the image corresponding to N periods from the rising of the HP signal. The density data obtained by reading the pattern 43 during N periods is equally divided into N sections. It is not necessary to form the pattern 43 so as to match with the timing of the image forming of the first reference mark 41 and the timing of the image forming of the second reference mark 42. It is sufficient to include the pattern 43 having the length corresponding to the necessary periods between the first reference mark 41 and the second reference mark 42.

As described above, by separating the stage in which the first reference mark 41 and the second reference mark 42 are formed and read, from the stage in which the pattern 43 is formed and read, it is possible to avoid the above-described memory effect. Further, in case that the first stage process is carried out at once, thereafter only the second stage process may be carried out two or more times. Preferably, the density unevenness is measured by using the patterns 43 having various densities. Therefore, in case that the first stage process and the second stage process are carried out as described above, it is possible to effectively measure the density unevenness in the sub-scanning direction.

As described above, the embodiment is explained by using the drawings. However, in the present invention, the concrete configuration is not limited to the above embodiment. In the present invention, various modifications of the above embodiment or the addition of various functions or the like to the embodiment can be carried out without departing from the gist of the invention.

In this embodiment, the first reference mark 41 and the second reference mark 42 are formed so as to synchronize with the rising of the HP signal, and the number of periods between the first reference mark 41 and the second reference mark 42 is N. However, it is not necessary to form the first reference mark 41 and the second reference mark 42 so as to synchronize with the rising of the HP signal. In case that the phase difference between each reference mark and the rising of the HP signal can be grasped, the first reference mark 41 and the second reference mark 42 may be formed at optional timings.

That is, it is sufficient to obtain the phase of the periodic member at the first timing at which the first reference mark 41 is formed on the recording medium or at the second timing at which the second reference mark 42 is formed on the recording medium, and the number of periods during which the periodic member is actuated from the first timing to the second timing. Then, for example, in accordance with the phase of the periodic member at the first timing (or the phase of the periodic member at the second timing), the number of the periods during which the periodic member is actuated between the first timing and the second timing (the number is not limited to an integer, for example, may be 5.3), and each position of the first reference mark 41 and the second reference mark 42 detected by the density detecting unit 20 in the density data, the relation between each position in the density data and the phase of the periodic member may be calculated. In accordance with the calculated relation, the portion corresponding to a plurality of periods from the predetermined phase of the periodic member (for example, the rising of the HP signal) may be obtained in the density data. The density data for one period may be calculated by summarizing the obtained portion and the correction data for one period of the periodic member may be prepared in accordance with the calculated density data for one period.

For example, in case that the phase of the periodic member at the first timing is 120 degrees and the number of the periods between the first timing and the second timing is 3.6, the length obtained by dividing the length between the position corresponding to the first reference mark 41 in the density data and the position corresponding to the second reference mark 42 in the density data, by 3.6 corresponds to one period of the periodic member. The position obtained by shifting from the position corresponding to the first reference mark 41 by ⅓ period (corresponding to 120 degrees) toward the side of the second reference mark 42 is found to be the position of the rising of the HP signal. Then, it is possible to obtain the density data for three periods by using the obtained position as the reference position.

In this embodiment, the pattern 43 is formed only between the first reference mark 41 and the second reference mark 42. However, as long as the pattern 43 having the length corresponding to a plurality of periods is arranged between the first reference mark 41 and the second reference mark 42, the starting point and the ending point of the pattern 43 may be optionally determined. Therefore, the pattern 43 may be started before the first reference mark 41. The pattern 43 may be continued beyond the second reference mark 42. Alternatively, the ending point of the pattern 43 may be positioned before the second reference mark 42 (near the first reference mark 41).

In this embodiment, each of the first reference mark 41 and the second reference mark 42 is black having the highest density. However, the density of each reference mark is not limited to this. The density of each reference mark is preferably determined so as to sufficiently secure the density difference between each reference mark and the original color of the recording medium or the pattern 43. Further, each shape of the first reference mark 41 and the second reference mark 42 is not limited to the shape shown in this embodiment. However, the edge of the starting point of each reference mark is preferably formed in a straight line which is parallel with the main scanning direction.

In this embodiment, the image forming apparatus 5 is a full-color printer. However, the image forming apparatus 5 may be a monochrome printer. The image forming unit 10 may form an image by a process other than the electrophotographic process.

The correction data is preferably updated at the timing at which the density unevenness in the sub-scanning direction is changed. For example, when the parts are deteriorated over a certain limit, when the parts are exchanged, or when the environment is changed over a certain limit, the correction data is preferably updated.

One of the objects of the above embodiment is to provide an image forming apparatus and a density unevenness correcting method which can correct the density unevenness in the conveying direction, which is caused due to the periodic member to be correction, so as to eliminate the influence due to the other members.

In this embodiment, the first reference mark and the second reference mark are formed at an interval in the conveying direction (the sub-scanning direction) and the pattern having the length corresponding to a plurality of periods is formed between the first reference mark and the second reference mark. For example, in case that the length between the first reference mark and the second reference mark corresponds to N periods of the periodic member, the range between the first reference mark and the second reference mark appearing on the density data corresponds to N periods. When the density data which is obtained between the first reference mark and the second reference mark is equally divided into N, the density data for one period can be exactly obtained. Further, in accordance with the phase of the periodic member at the first timing at which the first reference mark is formed or at the second timing at which the second reference mark is formed, it is possible to extract the density data for one period from the specific phase.

The number of periods during which the periodic member is actuated from the first timing to the second timing is not limited to an integer. The phase of the periodic member at the first timing and the phase of the periodic member at the second timing may be the same (for example, the rising of the HP signal) or may be different from each other. The periodic member is not limited to the member which executes the rotative motion, and may include the member which executes the reciprocal motion.

In this embodiment, the boundary between the pattern and the following second reference mark can be recognized by using the density difference therebetween.

In this embodiment, the density data of the portion to be averaged is obtained by eliminating the range in which the influence of the memory effect caused by forming the first reference mark is caused. The method for eliminating the above range includes the method in which the pattern is not formed and the method in which the pattern is formed, but the range in which the influence of the memory effect is caused is not used as the density data to be extracted (averaged).

In this embodiment, the first reference mark, the second reference mark and the pattern are formed so as to differentiate the positions of the first reference mark and the second reference mark in the direction perpendicular to the conveying direction (the main scanning direction) from the position of the pattern in the main scanning direction. Therefore, the above-described memory effect can be eliminated. Further, even though the first reference mark and pattern are formed in the same period, the density data of the pattern can be obtained without being influenced by the first reference mark.

In this embodiment, each density of the first reference mark, the second reference mark and the pattern can be detected by the same density detecting unit.

In this embodiment, the number of the periods between the first timing and the second timing is an integer. For example, in case that both of the first timing and the second timing are set to the rising of the HP signal, it is possible to easily extract the density data for one period by setting the rising of the HP signal to the head position of the density data.

According to the image forming apparatus and the density unevenness correcting method, it is possible to correct the density unevenness in the conveying direction, which is caused due to the periodic member to be correction, so as to eliminate the influence due to the other members.

The present U.S. patent application claims the priority of Japanese Patent Application No. 2014-037761, filed on Feb. 28, 2014, according to the Paris Convention, and the entirety of which is incorporated herein by reference for correction of incorrect translation.

What is claimed is:

1. An image forming apparatus, comprising:

an image forming unit configured to form an image on a conveyed recording medium;

a density detecting unit configured to detect a density of the image formed on the recording medium by the image forming unit;

a phase detecting unit configured to detect a phase of a predetermined periodic member which is a component part of the image forming unit and which is periodically actuated;

a control unit configured to instruct the image forming unit to form a pattern for measuring a density unevenness in a conveying direction of the recording medium on the recording medium, and to prepare correction data for one period of the periodic member from density data obtained by detecting the density of the pattern with the density detecting unit, the correction data being used for correcting the density unevenness in the conveying direction, which is caused due to the periodic member; and a density unevenness correcting unit configured to correct image data to be supplied to the image forming unit by repeatedly applying the correction data for one period so as to match with the phase of the periodic member, which is detected by the phase detecting unit, and to correct the density unevenness in the conveying direction, which is caused due to the periodic member, wherein the control unit instructs the image forming unit to form a first reference mark and a second reference mark at an interval in the conveying direction and the pattern having a length corresponding to two or more periods of the periodic member between the first reference mark and the second reference mark in the conveying direction, on the recording medium, wherein the control unit obtains the phase of the periodic member at a first timing at which the first reference mark is formed on the recording medium or the phase of the periodic member at a second timing at which the second reference mark is formed on the recording medium, and number of the periods during which the periodic member is actuated between the first timing and the second timing in accordance with the phase detected by the phase detecting unit, wherein the control unit calculates a relation between each position in the density data and the phase of the periodic member in accordance with at least one of the phase of the periodic member at the first timing and the phase of the periodic member at the second timing, the number of the periods during which the periodic member is actuated between the first timing and the second timing, a position corresponding to the first reference mark in the density data and a position corresponding to the second reference mark in the density data, wherein the control unit obtains a portion corresponding to a plurality of periods from a predetermined phase of the periodic member in the density data in accordance with the relation, and calculates the density data for one period by summarizing the obtained portion, and wherein the control unit prepares the correction data for one period of the periodic member in accordance with the calculated density data for one period.

2. The image forming apparatus of claim 1, wherein in case that the second reference mark is continuous with the pattern, a density of the second reference mark is differentiated from a density of the pattern.

3. The image forming apparatus of claim 1, wherein in a predetermined range from the first reference mark toward a downstream side in the conveying direction, the pattern is not formed, or the density data is not obtained from the predetermined range.

4. The image forming apparatus of claim 1, wherein positions of the first reference mark and the second reference mark in a direction perpendicular to the conveying direction are different from a position of the pattern in the direction perpendicular to the conveying direction.

5. The image forming apparatus of claim 1, wherein positions of the first reference mark and the second reference mark in a direction perpendicular to the conveying direction are same as a position of the pattern in the direction perpendicular to the conveying direction.

6. The image forming apparatus of claim 1, wherein the first timing and the second timing are a timing at which the periodic member has an identical predetermined phase.

7. The image forming apparatus of claim 1, wherein the periodic member executes a rotative motion.

8. A density unevenness correcting method for correcting a density unevenness in a conveying direction of a conveyed recording medium, which is caused in an image formed on the recording medium by an image forming unit and which is caused due to a predetermined periodic member which is a component part of the image forming unit and which is periodically actuated, the method comprising:

forming a first reference mark and a second reference mark at an interval in the conveying direction and a pattern for measuring the density unevenness in the conveying direction, on the recording medium, the pattern having a length corresponding to two or more periods of the periodic member between the first reference mark and the second reference mark in the conveying direction;

obtaining density data by detecting a density of the first reference mark, a density of the second reference mark and a density of the pattern with a density detecting unit;

obtaining a phase of the periodic member at a first timing at which the first reference mark is formed on the recording medium or a phase of the periodic member at a second timing at which the second reference mark is formed on the recording medium, and number of the periods during which the periodic member is actuated between the first timing and the second timing in accordance with a phase of the periodic member, which is detected by a phase detecting unit;

calculating a relation between each position in the density data and the phase of the periodic member in accordance with at least one of the phase of the periodic member at the first timing and the phase of the periodic member at the second timing, the number of the periods during which the periodic member is actuated between the first timing and the second timing, a position corresponding to the first reference mark in the density data and a position corresponding to the second reference mark in the density data;

obtaining a portion corresponding to a plurality of periods from a predetermined phase of the periodic member in the density data in accordance with the relation, and calculating the density data for one period by summarizing the obtained portion;

preparing correction data for one period of the periodic member in accordance with the calculated density data for one period, the correction data being used for correcting the density unevenness in the conveying direction, which is caused due to the periodic member; and correcting image data to be supplied to the image forming unit by repeatedly applying the correction data for one period so as to match with the phase of the periodic member, and correcting the density unevenness in the conveying direction, which is caused due to the periodic member.

* * * * *